US008170733B2

(12) United States Patent
Blum et al.

(10) Patent No.: US 8,170,733 B2
(45) Date of Patent: May 1, 2012

(54) VEHICLE CONTROL SYSTEM AND METHOD

(75) Inventors: Randall B. Blum, Peoria, IL (US); Douglas J. Carlton, Peoria, IL (US); Jordan T. Thomas, Pekin, IL (US); Geoffrey D. Ginzel, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1023 days.

(21) Appl. No.: 12/152,176

(22) Filed: May 13, 2008

(65) Prior Publication Data

US 2009/0287382 A1 Nov. 19, 2009

(51) Int. Cl.
*B63H 21/21* (2006.01)

(52) U.S. Cl. ..... 701/21; 701/54; 440/84

(58) Field of Classification Search ..... 701/21, 701/51, 54; 440/61 S, 84
See application file for complete search history.

(56) References Cited

U.S. PATENT DOCUMENTS 4,435,961 A * 3/1984 Stewart ..... 60/719
4,637,802 A * 1/1987 Taguchi et al. ..... 440/75
5,231,890 A * 8/1993 Hayasaka ..... 74/501.6
5,775,311 A * 7/1998 Kato et al. ..... 123/681
6,066,897 A 5/2000 Nakamura
6,234,853 B1 * 5/2001 Lanyi et al. ..... 440/53
6,587,765 B1 * 7/2003 Graham et al. ..... 701/21
6,594,998 B2 7/2003 Bogucki
6,665,606 B2 12/2003 Mathew et al.
6,853,891 B2 2/2005 Hasler et al.
6,916,271 B2 * 7/2005 Booth et al. ..... 477/181
6,923,696 B2 * 8/2005 Okuyama ..... 440/85
7,104,212 B2 9/2006 Brianza
7,142,955 B1 * 11/2006 Kern et al. ..... 701/21
7,455,557 B2 * 11/2008 Mizutani ..... 440/1
7,993,175 B2 * 8/2011 Hiroshima et al. ..... 440/84
2007/0055419 A1 * 3/2007 List et al. ..... 701/21
2010/0280684 A1 * 11/2010 Garon ..... 701/21

* cited by examiner

*Primary Examiner* — Ruth Ilan
*Assistant Examiner* — Timothy Wilhelm
(74) *Attorney, Agent, or Firm* — Robin S. Fahlberg

(57) ABSTRACT

A vehicle control system includes a first powertrain, a second powertrain, and a third powertrain. The first powertrain includes a first power source. The second powertrain includes a second power source. The third powertrain includes a third power source. The vehicle control system also includes an operator control interface. The operator control interface includes a first portion configured to receive a first operator input and a second portion configured to receive a second operator input. The first operator input and the second operator input are indicative of a desired speed and a desired direction. The vehicle control system additionally includes a controller configured to deliver a power control signal to at least one of the first powertrain, the second powertrain, and the third powertrain. The power control signal is a function of the first operator input and the second operator input.

19 Claims, 5 Drawing Sheets

VEHICLE CONTROL SYSTEM AND METHOD

TECHNICAL FIELD

This patent disclosure relates generally to a system and method to control a vehicle and, more particularly to a system and method to control a vehicle with multiple powertrains.

BACKGROUND

Vehicles, such as for example marine vessels, are subject to increased regulations on exhaust emissions and noise. Meeting these regulations can cause increased fuel consumption. Many vehicle owners and/or operators are additionally demanding more horsepower be available in their vehicle. Increasing engine size to meet power demands increases fuel consumption. Utilizing a greater number of lower horsepower engines instead of a smaller number of higher horsepower engines may mitigate the fuel consumption loss, still meet increased regulation requirements, and provide owners and operators increased horsepower.

While demanding higher horsepower and better fuel economy, vehicle owners and operators may desire that the vehicle operator interface look and feel the same. For example, if a marine vessel operator is accustomed to using two throttles to control two engines, he/she may desire the same two throttles to control three or more engines. If a vehicle operator is accustomed to selecting between two or more modes to control a vehicle with two powertrains, he/she may desire the same selection of modes be available in a vehicle with three or more powertrains and that the modes operate in the same manner.

U.S. Pat. No. 6,853,891 to Hasler et al discloses apparatuses and methods for controlling the engine speed of an engine. A throttle receives an operator input indicative of a desired engine speed. A first sensor is coupled with the throttle, and transmits a throttle signal indicative of a position of the throttle. A minimum speed governor is coupled with the first sensor to receive the throttle signal. The minimum speed governor determines a rate of change of the throttle signal, and transmits a minimum engine speed signal indicative of a desired minimum engine speed of the engine as a function of the rate of change of the throttle signal.

SUMMARY OF THE INVENTION

A vehicle control system is disclosed. The vehicle control system includes a first powertrain, a second powertrain, and a third powertrain. The first powertrain includes a first power source. The second powertrain includes a second power source. The third powertrain includes a third power source. The vehicle control system also includes an operator control interface. The operator control interface includes a first portion configured to receive a first operator input and a second portion configured to receive a second operator input. The first operator input and the second operator input are indicative of a desired speed and a desired direction. The vehicle control system additionally includes a controller configured to deliver a power control signal to at least one of the first powertrain, the second powertrain, and the third powertrain. The power control signal is a function of the first operator input and the second operator input.

A vehicle control method is disclosed. The vehicle control method includes receiving a first operator input, receiving a second operator input, and delivering a power control signal to at least one of a first powertrain, a second powertrain, and a third powertrain. The first powertrain includes a first power source. The second powertrain includes a second power source. The third powertrain includes a third power source. The first operator input and the second operator input are indicative of a desired speed and a desired direction. The power control signal is a function of the first operator input and the second operator input.

A vehicle including a first powertrain, a second powertrain, and a third powertrain is disclosed. The first powertrain includes a first engine. The second powertrain includes a second engine. The third powertrain includes a third engine. The vehicle also includes an operator control interface. The operator control interface includes a first portion configured to receive a first operator input and a second portion configured to receive a second operator input. The first operator input and the second operator input are indicative of a desired speed and a desired direction. The vehicle additionally includes a controller configured to deliver a power control signal to at least one of the first powertrain, the second powertrain, and the third powertrain. The power control signal is a function of the first operator input and the second operator input.

A marine vessel is disclosed. The marine vessel includes a port side powertrain, a starboard side powertrain, and a center powertrain. The port side powertrain includes a first engine. The starboard side powertrain includes a second engine. The center powertrain includes a third engine. The marine vessel also includes an operator control interface. The operator control interface includes a first throttle configured to receive a first operator input and a second throttle configured to receive a second operator input. The first operator input and the second operator input are indicative of a desired speed and a desired direction. The marine vessel additionally includes a controller configured to deliver a power control signal to at least one of the port side powertrain, the starboard side powertrain, and the center powertrain. The power control signal is a function of the first operator input and the second operator input.

BRIEF DESCRIPTION OF THE DRAWINGS

The accompanying drawings, which are incorporated in and constitute a part of this specification, illustrate exemplary embodiments or features of the disclosure and, together with the description, help explain principles of the disclosure. In the drawings.

Although the drawings depict exemplary embodiments or features of the present disclosure, the drawings are not necessarily to scale, and certain features may be exaggerated in order to provide better illustration or explanation. The exemplifications set out herein illustrate exemplary embodiments or features, and such exemplifications are not to be construed as limiting the inventive scope in any manner.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts.

Figure 1:
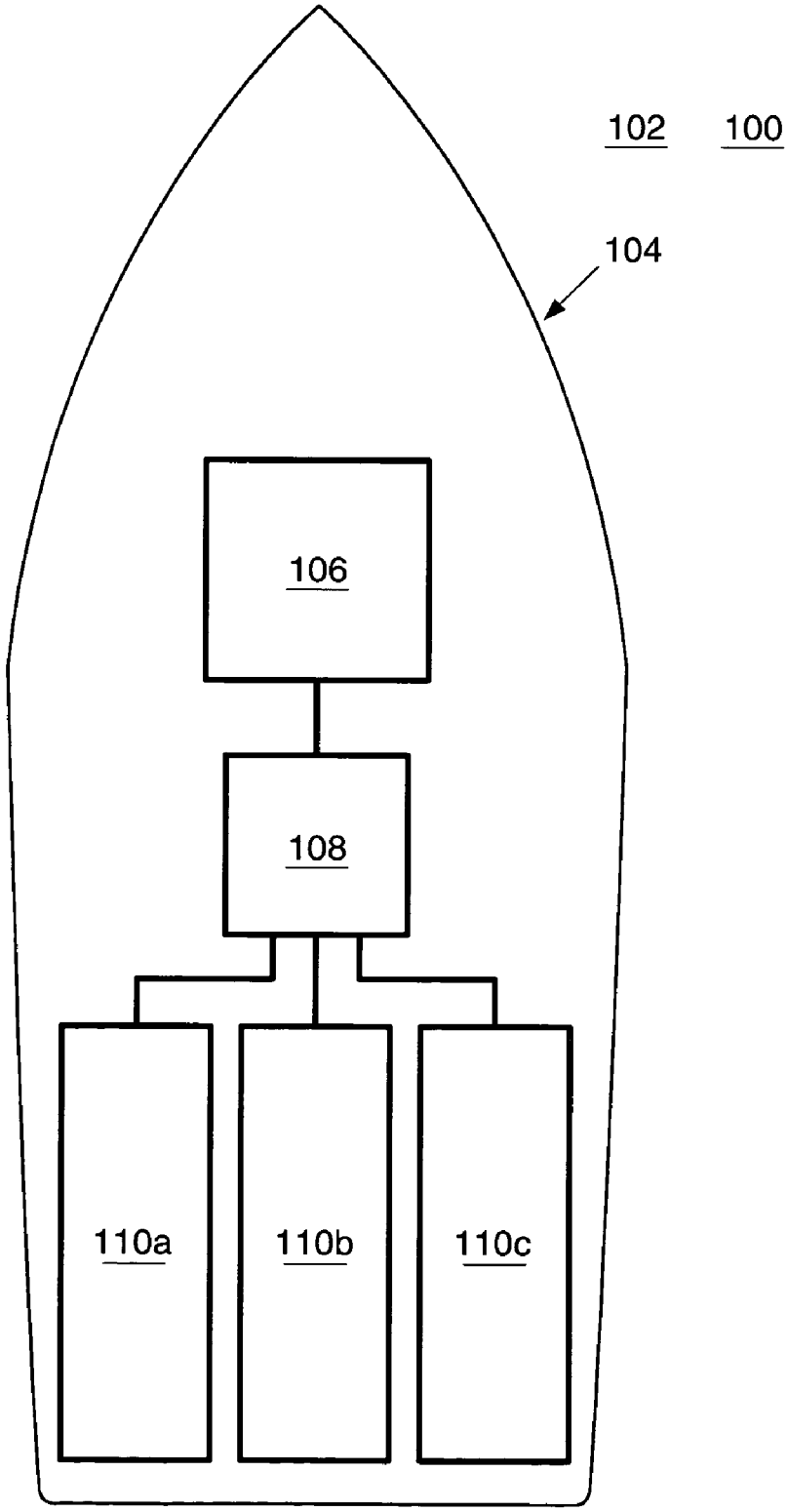
FIG. 1 is a schematic illustration of a vehicle control system.

FIG. 1 illustrates an exemplary embodiment of a vehicle control system 100. The vehicle control system may include, be located on, or control a vehicle 102. In the exemplary embodiment illustrated, the vehicle 102 includes a marine vessel 104. In alternative embodiments the vehicle 102 may include any mobile machine. The vehicle 102 may include but is not limited to machines that transport passengers, goods, and apparatus. The vehicle 102 may include but is not limited to work vehicles that perform some type of operation associated with a particular industry such as mining, construction, farming, transportation, etc. and operate between or within work environments (e.g. construction site, mine site, power plants, on-highway applications, marine applications, etc.). Vehicle 102 may include any type of automobile or commercial vehicle. Non-limiting examples of vehicle 102 include on-highway vehicles, commercial machines such as trucks, cranes, earthmoving vehicles, mining vehicles, backhoes, loaders, material handling equipment, farming equipment, marine vessels, aircraft, and any type of movable machine. Vehicle 102 may include mobile machines which operate on land, in water, in the earth's atmosphere, or in space. Land vehicles may include mobile machines with tires, tracks, or other ground engaging devices.

The vehicle control system 100 may include an operator control interface 106, a controller 108, a first powertrain 110A, a second powertrain 110B, and a third powertrain 110C.

The operator control interface 106 may be configured to receive commands from an operator indicative of a desired vehicle direction and a desired vehicle speed. The operator control interface 106 may be operably connected to the controller 108. Operably connected includes being joined, fastened, or connected in such a manner that a first device is able to actuate, communicate with, or transfer power to another device. Operably connected may include any system or method for establishing communication and/or data transfer, actuating a device, or transferring power from one device or machine to another device or machine. Such systems or methods may include, mechanical connections, fluid connections, pneumatic connections, electronics, magnetics, optics, radio, cellular, and/or sound techniques as well as others not expressly described herein. Operably connected is not intended to be limited to a mechanical or hard-wired form of actuation, power transfer, communication, or data transfer.

The controller 108 may be configured to receive signals from the operator control interface 106 indicative of a desired direction and a desired speed. The controller 108 may be operably connected to the first powertrain 110A, the second powertrain 110B, and the third powertrain 110C. The controller 108 may be configured to deliver a power control signal to at least one of the first powertrain 110A, the second powertrain 110B, and the third powertrain 110C.

The controller 108 may include a processor (not shown) and a memory component (not shown). The processor may be a microprocessor or other processor as known in the art.

The controller 108 may be operably coupled to the first powertrain 110A, the second powertrain 110B, and the third powertrain 110C. The processor may execute instructions and deliver a power control signal to at least one of the first powertrain 110A, the second powertrain 110B, and the third powertrain 110C, as described below in connection with FIGS. 4 and 5.

Such instructions may be read into or incorporated into a computer readable medium, such as the memory component or provided external to processor. In alternative embodiments, hard-wired circuitry may be used in place of or in combination with software instructions to implement a vehicle control method. Thus embodiments are not limited to any specific combination of hardware circuitry and software.

The term "computer-readable medium" as used herein refers to any medium or combination of media that participates in providing instructions to processor for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics, and can also take the form of acoustic or light waves, such as those generated during radio-wave and infrared data communications.

Common forms of computer-readable media include, for example, a floppy disk, a flexible disk, hard disk, magnetic tape, or any other magnetic medium, a CD-ROM, any other optical medium, punch cards, papertape, any other physical medium with patterns of holes, a RAM, a PROM, and EPROM, a FLASH-EPROM, any other memory chip or cartridge, a carrier wave as described hereinafter, or any other medium from which a computer or processor can read.

The memory component may include any form or combination of forms of computer-readable media as described above. In the illustrated embodiment, the memory component is located on-board the vehicle 102. In an alternative embodiment, the memory component may be located remotely. In still another alternative embodiment, the memory component may include several types of computer readable media some located on-board and some located remotely.

The processor and the memory component may be contained in one or more units. One embodiment with multiple processor and memory component units is described below in relation to FIG. 3. These multiple processor and memory component units may be located on-board the vehicle 102 or off-board.

The controller 108 is not limited to electronic and electrical circuitry and software. In other embodiments the controller 108 may include hydraulic circuits, pneumatic circuits, mechanical control devices, or a combination of these and electronic and electrical circuitry and software may implement a control method.

The first powertrain 110A may be configured to receive a power control signal from the controller 108. The second powertrain 110B may be configured to receive a power control signal from the controller 108. The third powertrain 110C may be configured to receive a power control signal from the controller 108.

Figure 2:
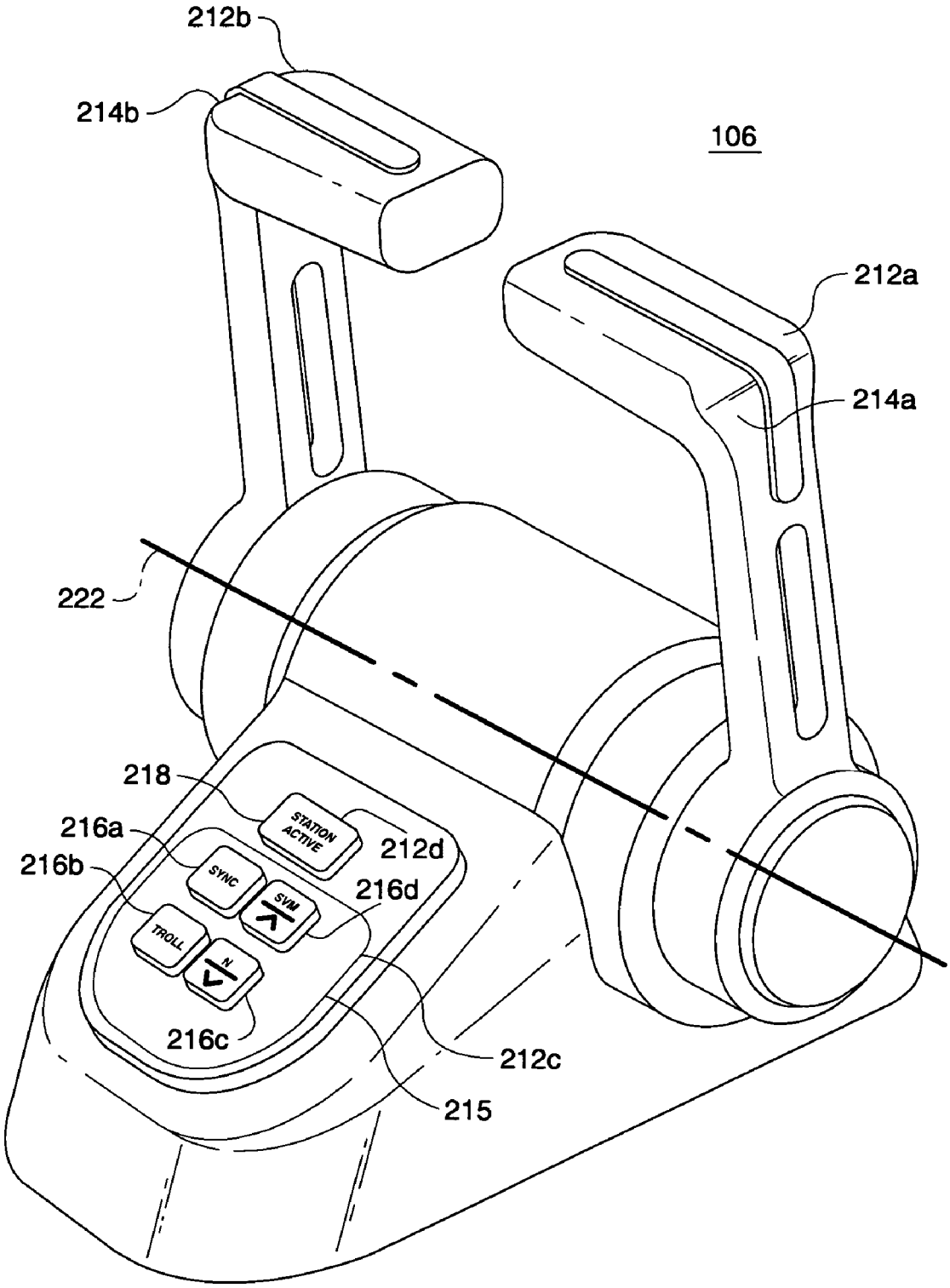
FIG. 2 is a schematic illustration of an operator control interface.

Referring now to FIG. 2, an exemplary embodiment of the operator control interface 106 is illustrated. The operator control interface 106 in this embodiment may be on a marine vessel 104. The operator control interface 106 may include devices with which a vehicle operator communicates to, interacts with, or controls the vehicle 102. The operator control interface 106 may include devices with which the operator interacts physically or they may include voice activation devices. The operator control interface 106 may be located on-board the vehicle 102 or off-board the vehicle 102.

The operator control interface 106 may include a first portion 212A, a second portion 212B, a third portion 212C, and a fourth portion 212D.

The first portion 212A may include a first throttle 214A. The first throttle 214A may include a hand operated lever-type control device, with a generally elongated shape. The first throttle 214A may be rotatable around an axis 222. The rotational displacement of the first throttle 214A around the axis 222 in relation to a neutral position may be indicative of a desired vehicle speed and a desired vehicle direction. The first throttle 214A may include a portion with a handgrip or shape that is comfortable for an operator to grasp with a hand.

In an alternative embodiment the first throttle 214A may be movable linearly along an axis 222. The linear displacement of the first throttle 214A in relation to a neutral position along the axis 216 may be indicative of a desired vehicle direction and a desired vehicle speed.

In other embodiments the first portion 212A may include an alternative operator input device. The operator input device may include one or more switches, buttons, keyboards, interactive displays, levers, dials, remote control devices, voice activated controls, or any other operator input devices that a person skilled in the art now or in the future would understand would be functional for an operator to input a command.

The second portion 212B may include a second throttle 214B. The second throttle 214B may include a hand operated lever-type control device, with a generally elongated shape. The second throttle 214B may be rotatable around an axis 222. The rotational displacement of the second throttle 214B around the axis 222 in relation to a neutral position may be indicative of a desired vehicle speed and a desired vehicle direction. The second throttle 214B may include a portion with a handgrip or shape that is comfortable for an operator to grasp with a hand.

In an alternative embodiment the second throttle 214B may be movable linearly along an axis 222. The linear displacement of the second throttle 214B in relation to a neutral position along the axis 222 may be indicative of a desired vehicle direction and a desired vehicle speed.

In other embodiments the second portion 212B may include an alternative operator input device. The operator input device may include one or more switches, buttons, keyboards, interactive displays, levers, dials, remote control devices, voice activated controls, or any other operator input devices that a person skilled in the art now or in the future would understand would be functional for an operator to input a command.

Moving the first throttle 214A in a generally forward direction, corresponding to rotating the first throttle 214A clockwise in the embodiment depicted, may indicate that the vehicle 102 operator desires more forward power on a first side of the vehicle 102. Moving the first throttle 214A in a generally reverse direction, corresponding to rotating the first throttle 214A counter-clockwise in the embodiment depicted, may indicate that the vehicle 102 operator desires more reverse power on a first side of the vehicle 102.

Moving the second throttle 214B in a generally forward direction, corresponding to rotating the first throttle 214B counter-clockwise in the embodiment depicted, may indicate that the vehicle 102 operator desires more forward power on a second side of the vehicle 102. Moving the second throttle 214B in a generally reverse direction, corresponding to rotating the first throttle 214B clockwise in the embodiment depicted, may indicate that the vehicle 102 operator desires more reverse power on a second side of the vehicle 102.

The second side of the vehicle 102 may be opposite the first side of the vehicle 102. For example, the first side of the vehicle 102 may be the starboard side of the marine vessel 104. The second side of the vehicle 102 may be the port side of the marine vessel 104.

In an alternative embodiment the vehicle 102 may be a tracked land vehicle and the first side of the vehicle 102 may be the right side and the second side of the vehicle may be the left side.

The position of the first throttle 214A in relationship to the second throttle 214B may be indicative of a desired direction on the vehicle 102. For example, moving one of the first throttle 214A and the second throttle 214B further forward than the other may indicate that the operator desires more forward power on one side of the vehicle 102 than the other and such that the direction of the vehicle 102 may change.

The amount of displacement in a generally forward or a generally reverse direction of the first throttle 214A and the second throttle 214B may be indicative of a desired speed of the vehicle 102.

The third portion 212C may be a mode selector 215. The mode selector 215 may be configured to select between two or more modes. The mode selector 215 may include one or more depressible devices 216. For example, the mode selector 215 may include a first depressible device 216A, a second depressible device 216B, a third depressible device 216C, and a fourth depressible device 216D. The selected mode may be indicative of a desired vehicle direction and a desired vehicle speed.

In one embodiment, an automatic mode may be selected when none of the one or more depressible devices 216 are depressed. A synch mode may be selected when the first depressible device 216A is depressed. A trolling mode may be selected when the second depressible device 216B is depressed. A neutral mode may be selected when the third depressible device 216C is depressed. A slow vessel mode may be selected when the fourth depressible device 216D is depressed. As described in relationship to FIGS. 4 and 5, the selected mode may be indicative of a desired vehicle speed and a desired vehicle direction.

In other embodiments the mode selector 215 may include one or more alternative operator input devices. The one or more operator input devices may include one or more switches, buttons, keyboards, interactive displays, levers, dials, remote control devices, voice activated controls, or any other operator input devices that a person skilled in the art now or in the future would understand would be functional for an operator to select a mode.

The fourth portion 212D may include an activation device 218. The activation device 218 may include a depressible device configured to activate the operator control interface 106 to allow communication between the vehicle operator and the controller 108.

In other embodiments the activation device 218 may include an alternative operator input device. The operator input device may include one or more switches, buttons, keyboards, interactive displays, levers, dials, remote control devices, voice activated controls, or any other operator input devices that a person skilled in the art now or in the future would understand would be functional for an operator to activate the operator control interface 106.

In alternative embodiments the fourth portion 212D may be configured to be indicative of any operator command. For example the fourth portion 212D may activate an audio signal such as a horn device. In another embodiment the fourth portion 212D may activate illuminating devices. In still another embodiment the fourth portion 212D may relay any operator command as would be known by someone skilled in the art now or in the future. In still another embodiment the operator control interface 106 may not include a fourth portion 212D.

Figure 3:
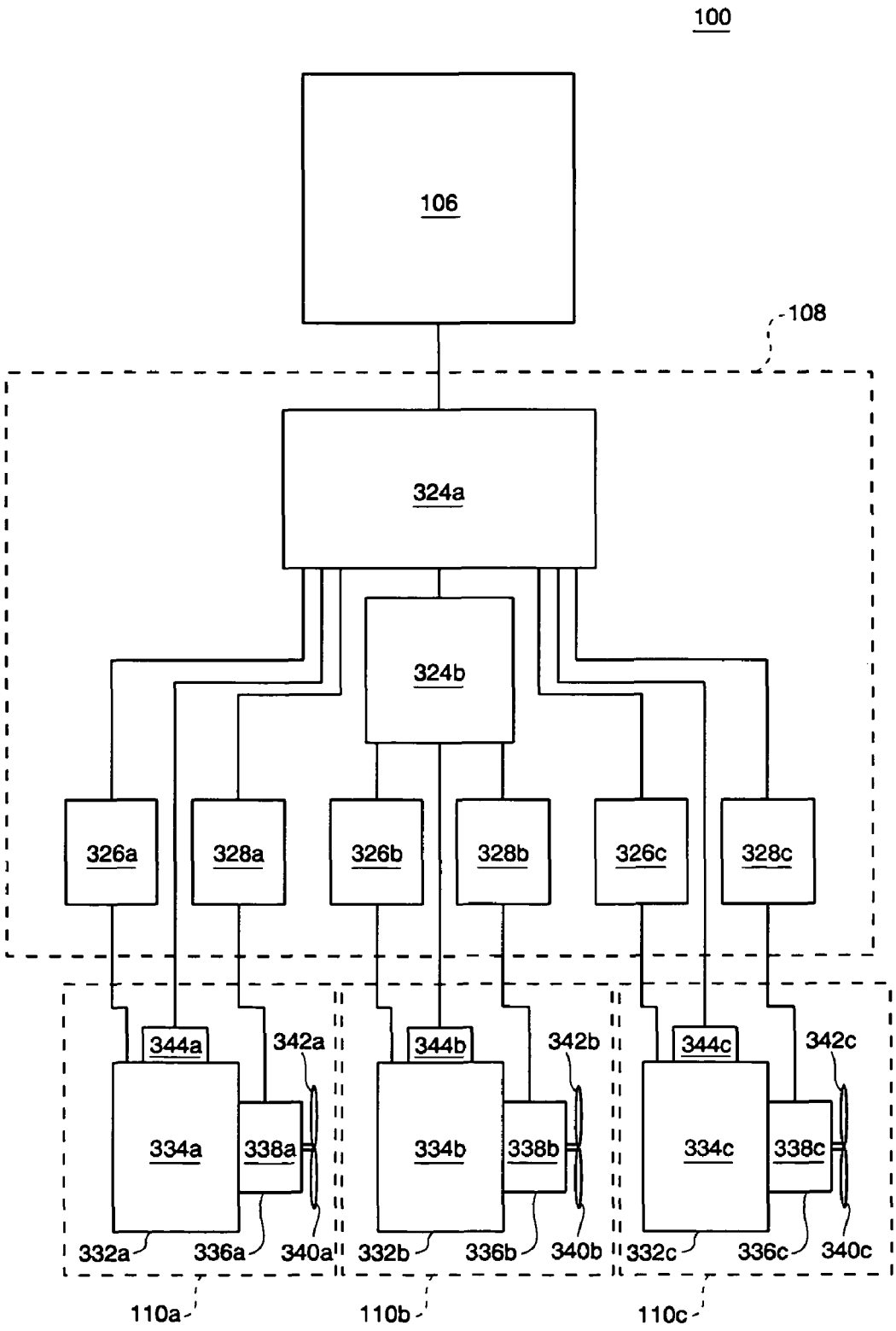
FIG. 3 is a schematic illustration of a vehicle control system

Referring now to FIG. 3, an exemplary embodiment of the vehicle control system 100 is depicted. The vehicle control system 100 depicted may control a marine vessel 104. The vehicle control system 100 may include the operator control interface 106, the controller 108, the first powertrain 110A, the second powertrain 110B, and the third powertrain 110C. The first powertrain 110A may provide power generally on the left (port) side of the vehicle 102. The third powertrain 110C may provide power generally on the right (starboard) side of the vehicle 102. The second powertrain 110B may provide power generally to the center of the vehicle 102. In alternative embodiments the powertrains 110 may provide power generally to any side or area of the vehicle 102 as would be known by someone skilled in the art now or in the future.

The first powertrain 110A may include a first power source 332A. The first power source 332A may include a first engine 334A. The first engine 334A may be an internal combustion engine. In other embodiments the first engine 334A may be one of a rotary engine, a turbine, and a jet engine.

In alternative embodiments the first power source 332A may include any source or means of supplying energy as would be known by one skilled in the art now or in the future.

For the purposes of this application, a power source may supply but is not limited to electric, hydraulic, pneumatic, or mechanical energy. A power source supplying electric energy may include but is not limited to one of an electric power generator, a battery, and a fuel cell. A power source supplying hydraulic energy may include but is not limited to a pump. The pump may include one of a variable displacement pump, a variable speed pump, a fixed displacement pump, and a single speed pump. A power source supplying mechanical power may include but is not limited to one of any type engine and a turbine. A power source supplying pneumatic power may include but is not limited to an air compressor.

The first powertrain 110A may include a first transmission 336A. The first transmission 336A may include a mechanical transmission 338A with one forward and one reverse gear.

For purposes of this application a transmission may include one or more of a mechanical transmission, any CVT, gearing, belts, pulleys, discs, chains, pumps, motors, clutches, brakes, torque converters, and any transmission that would be known by one skilled in the art now or in the future.

The first powertrain 110A may include a first propelling device 340A. For purposes of this application, a propelling device may be any device that receives power transmitted through a powertrain and propels a vehicle forward. In a marine vessel 104 this may include but is not limited to one of a propeller and an impeller. On a land vehicle a propelling device may include but is not limited to tracks, tires, and other ground engaging devices.

The first propelling device 340A may include a first propeller 342A. The first propeller 342A may include a shaft with radiating blades that may be placed so as to thrust water in a desired direction when spinning and propel the marine vessel 104 in a direction. In an alternative embodiment the first propelling device 340A may include an impeller.

The first power source 332A may be operably coupled and transmit power to the first transmission 336A such. The first transmission 336A may be operably coupled and transmit power to the first propelling device 340A.

The first engine 334A may include a first speed sensor 344A. The first speed sensor 344A may be configured to generate a signal indicative of the speed of the first engine 334A. The first speed sensor 344A may be operably coupled to the controller 108.

The second powertrain 110B may include a second power source 332B. The second power source 332B may include a second engine 334B. The second engine 334B may be an internal combustion engine. In other embodiments the second engine 334B may be one of a rotary engine, a turbine, and a jet engine.

In alternative embodiments the second power source 332B may include any source or means of supplying energy.

The second powertrain 110B may include a second transmission 336B. The second transmission 336B may include a mechanical transmission 338B with one forward and one reverse gear.

The second powertrain 110B may include a second propelling device 340B. The second propelling device 340B may include a second propeller 342B. The second propeller 342B may include a shaft with radiating blades that may be placed so as to thrust water in a desired direction when spinning and propel the marine vessel 104 in a direction. In an alternative embodiment the second propelling device 340B may include an impeller.

The second power source 332B may be operably coupled and transmit power to the second transmission 336B. The second transmission 336B may be operably coupled and transmit power to the second propelling device 340B.

The second engine 334B may include a second speed sensor 344B. The second speed sensor 344B may be configured to generate a signal indicative of the speed of the second engine 334B. The second speed sensor 344B may be operably coupled to the controller 108.

The third powertrain 110C may include a third power source 332C. The third power source 332C may include a third engine 334C. The third engine 334C may be an internal combustion engine. In other embodiments the third engine 334C may be one of a rotary engine, a turbine, and a jet engine. In alternative embodiments the third power source 332C may include any source or means of supplying energy.

The third powertrain 110C may include a third transmission 336C. The third transmission 336C may include a mechanical transmission 338C with one forward and one reverse gear.

The third powertrain 110C may include a third propelling device 340C. The third propelling device 340C may include a third propeller 342C. The third propeller 342C may include a shaft with radiating blades that may be placed so as to thrust water in a desired direction when spinning and propel the marine vessel 104 in a direction. In an alternative embodiment the third propelling device 340C may include an impeller.

The third power source 332C may be operably coupled and transmit power to the third transmission 336C. The third transmission 336C may be operably coupled and transmit power to the third propelling device 340C.

The third engine 334C may include a third speed sensor 344C. The third speed sensor 344C may be configured to generate a signal indicative of the speed of the third engine 334C. The third speed sensor 344C may be operably coupled to the controller 108.

In alternate embodiments the third powertrain 110C may include components of one or both of the first powertrain 110A and the second powertrain. For example, the third powertrain 110C may include the third power source 332C and be operably coupled and transmit power to one of the first propelling device 340A and the second propelling device 340B. The controller 108 may be configured to deliver signals to the third powertrain 110C to actuate operable coupling of the third power source 332C to components of one or both of the first powertrain 110A and the second powertrain 110B. When operably coupled to components of one or both of the first powertrain 110A and the second powertrain 110B, the third power source 332C may transmit power to one or both of the first propelling device 340A and the second propelling device 340B. In these exemplary embodiments, the third powertrain 110C includes components of one or both of the first powertrain 110A and the second powertrain 110B.

The controller 108 may include one or more units. In one embodiment, each unit may include one or more processors and memory components. In another embodiment some units may contain a processor and others a memory component. In the exemplary embodiment illustrated, the controller 108 may include a master controller 324A, a follower controller 324B, a first engine controller 326A, a second engine controller 326B, a third engine controller 326C, a first transmission controller 328A, a second transmission controller 328B, and a third transmission controller 328C. In alternative embodiments the controller 108 may contain any number of units with each unit performing any of the overall functions of the controller 108.

The master controller 324A and the follower controller 324B may be configured to receive and generate vehicle 102 control signals.

The first engine controller 326A may be operably coupled to the first engine 334A. The first engine controller 326A may be configured to deliver control signals to the first engine 334A. The first engine controller 326A may be configured to receive engine operating signals from the first engine 334A.

The second engine controller 326B may be operably coupled to the second engine 334B. The second engine controller 326B may be configured to deliver control signals to the second engine 334B. The second engine controller 326B may be configured to receive engine operating signals from the second engine 334B.

The third engine controller 326C may be operably coupled to the third engine 334C. The third engine controller 326C may be configured to deliver control signals to the third engine 334C. The third engine controller 326C may be configured to receive engine operating signals from the third engine 334C.

The first transmission controller 328A may be operably coupled to the first transmission 336A. The first transmission controller 328A may be configured to deliver control signals to the first transmission 336A. The first transmission controller 328A may be configured to receive transmission operating signals from the first transmission 336A.

The second transmission controller 328B may be operably coupled to the second transmission 336B. The second transmission controller 328B may be configured to deliver control signals to the second transmission 336B. The second transmission controller 328B may be configured to receive transmission operating signals from the second transmission 336B.

The third transmission controller 328C may be operably coupled to the third transmission 336C. The third transmission controller 328C may be configured to deliver control signals to the third transmission 336C. The third transmission controller 328C may be configured to receive transmission operating signals from the third transmission 336C.

The operator control interface 106 may be operably coupled to the master controller 324A. The master controller 324A may be configured to receive one or more signals from the operator control interface 106 indicative of a desired direction and a desired speed.

The master controller 324A may be operably coupled to the follower controller 324B. The follower controller 324B may be configured to receive a signal indicative of a desired direction and a desired speed from the master controller 324A. The follower controller 324B may be configured to receive a signal indicative of a power control command from the master controller 324A.

The master controller 324A may be operably coupled to the first engine controller 326A, the third engine controller 326C, the first transmission controller 328A, and the third transmission controller 328C. The first engine controller 326A may be configured to receive a power control signal from the master controller 324A. The third engine controller 326C may be configured to receive a power control signal from the master controller 324A. The first transmission controller 328A may be configured to receive a power control signal from the master controller 324A. The third transmission controller 328C may be configured to receive a power control signal from the master controller 324A.

The follower controller 324B may be operably coupled to the second engine controller 326B, and the second transmission controller 328B. The second engine controller 326B may be configured to receive a power control signal from the follower controller 324B. The second transmission controller 328B may be configured to receive a power control signal from the follower controller 324B.

The first speed sensor 344A may be operably coupled to the master controller 324A. The second speed sensor 344B may be operably coupled to the follower controller 324B. The third speed sensor may be operably coupled to the master controller 324A.

It will be apparent to one skilled in the art that an unlimited number of embodiments with multiple control unit configurations are possible. The foregoing description of the embodiment illustrated in FIG. 3 is meant to be exemplary and not limiting. Controller 108 may include one or any other number of units. Components of the first powertrain 110A, the second powertrain 110B, and the third powertrain 110C may be operably coupled to any unit of the controller 108, and be configured to receive signals from any unit of the controller 108. Any unit of the controller 108 may be configured to receive signals from any of the components of the first powertrain 110A, the second powertrain 110B, and the third powertrain 110C. Any of the units of the controller 108 may be configured to receive signals from any of the other units of the controller 108.

INDUSTRIAL APPLICABILITY

Figure 4:
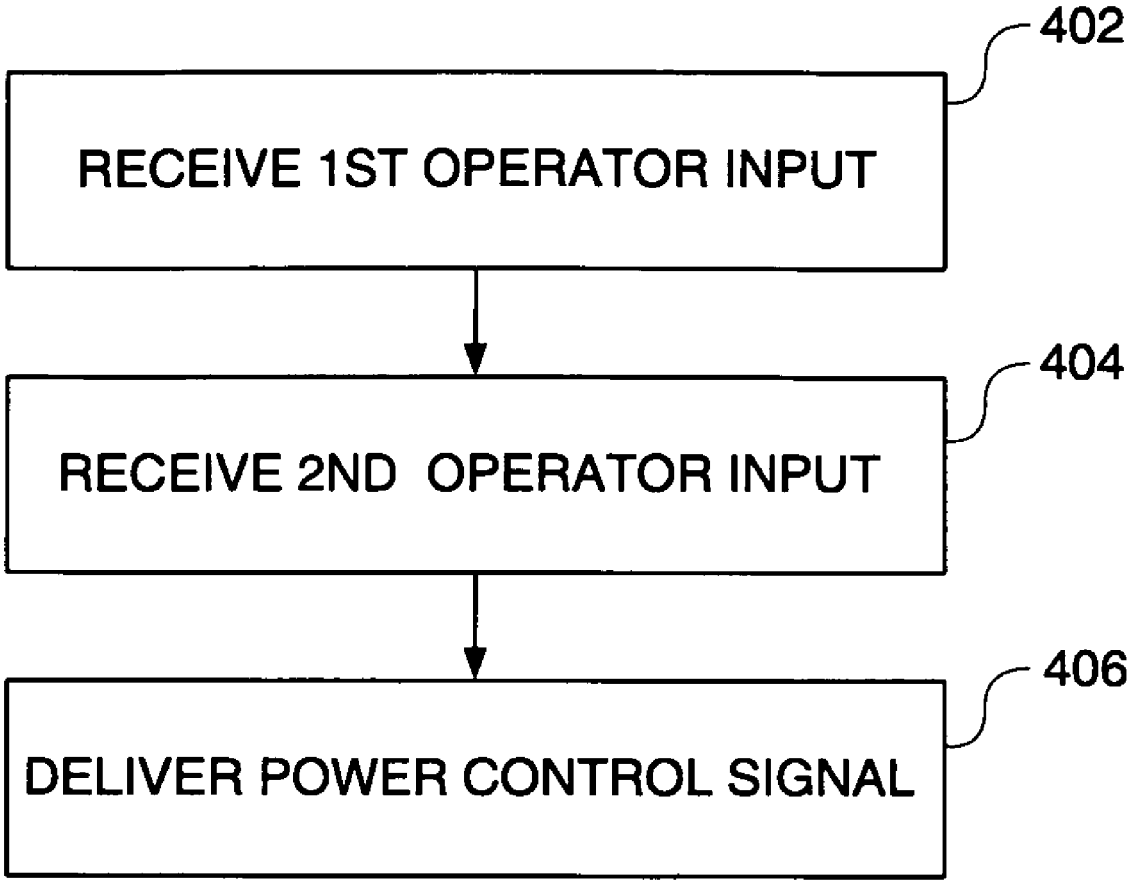
FIG. 4 is a flow chart of an exemplary method for controlling a vehicle, and, FIG. 5 is a flow chart of an exemplary method for controlling a vehicle.

Referring now to FIG. 4, an exemplary embodiment of a method to control a vehicle 102 is depicted. The method may include the steps of receiving a first operator input 402, receiving a second operator input 403, and delivering a power control signal 403.

An operator of a vehicle 102 may communicate a desired speed and a desired direction through the operator control interface 106. The operator may input a first communication signal through the first portion 212A of the operator control interface 106, and a second communication signal through the second portion 212B of the operator control interface 106. The desired speed and the desired direction may be a function of the first communication signal and the second communication signal.

For example, the operator may communicate a first operator input by moving the first throttle 214A to indicate a desired power on the starboard side of the marine vessel 104. The operator may communicate a second operator input by moving the second throttle 214B to indicate a desired power on the port side of the marine vessel 104. The desired speed and the desired direction of the marine vessel 104 may be a function of the desired power on the port side of the marine vessel 104 and the desired power on the starboard side of the marine vessel 104 as would be well known to someone skilled in the art. The marine vessel 104 may also include one or more additional steering devices such as a rudder (not shown). The desired direction may be a function of the operation of one or more additional steering devices as well as a function of the first operator input and the second operator input.

In another exemplary example, the vehicle 102 may be a tracked loader or other tracked land vehicle (not shown). The tracked vehicle may have a right track and a left track. The speed and direction of the tracked vehicle may be a function of the speed of the right track and the speed of the left track as would be well known to someone skilled in the art. The operator may communicate a first operator input through the first portion 212A to indicate a desired track speed on the right side of the tracked vehicle. The operator may communicate a second operator input through the second portion 212B to indicate a desired track speed on the left side of the tracked vehicle.

The controller 108 may receive a signal indicative of the first operator input (402). The controller may receive a signal indicative of the second operator input (404). The controller 108 may deliver a power control signal to at least one of first powertrain 110A, the second powertrain 110B, and the third powertrain 110C (406).

In an exemplary non-limiting embodiment, the controller 108 may deliver a first power control signal to the first engine 334A indicative of a desired first engine 334A speed. For example, the controller 108 may receive a signal indicative of the current first engine 334A speed from the first speed sensor 344A. The controller 108 may deliver a fueling signal to the first engine 334A to either increase or decrease the first engine 334A speed until the current first engine 334A speed, as indicated by the first speed sensor 344A, is substantially the same as the desired first engine 334A speed. This method of controlling engine speed is well known by those skilled in the art.

The controller 108 may deliver a second power control signal to the second engine 334B indicative of a desired second engine 334B speed. For example, the controller 108 may receive a signal indicative of the current second engine 334B speed from the second speed sensor 344B. The controller 108 may deliver a fueling signal to the second engine 334B to either increase or decrease the second engine 334B speed until the current second engine 334B speed, as indicated by the second speed sensor 344B, is substantially the same as the desired second engine 334B speed.

The controller 108 may deliver a third power control signal to the third engine 334C indicative of a desired third engine 334C speed. For example, the controller 108 may receive a signal indicative of the current third engine 334C speed from the third speed sensor 344C. The controller 108 may deliver a fueling signal to the third engine 334C to either increase or decrease the third engine 334C speed until the current third engine 334C speed, as indicated by the third speed sensor 344C, is substantially the same as the desired third engine 334C speed.

In another exemplary non-limiting embodiment, the controller 108 may deliver a first power control signal to the first transmission 336A indicative of a desired clutch control, a second power control signal to the second transmission 336B indicative of a desired clutch control, and a third power control signal to the third transmission 334C indicative of a desired clutch control.

Figure 5:
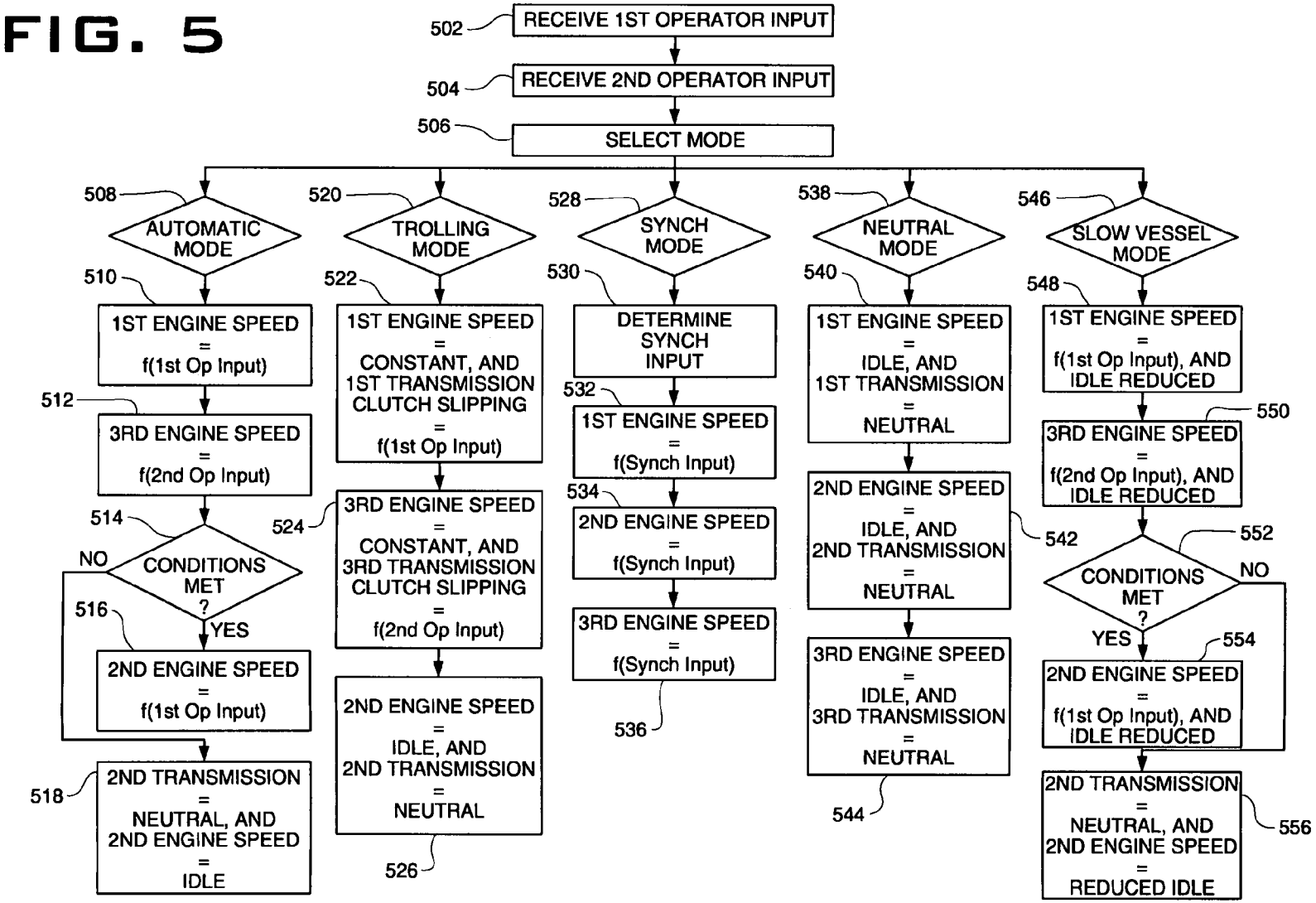

Referring now to FIG. 5, an exemplary non-limiting embodiment of a vehicle 102 control method is depicted. The method may include the steps of receiving a first operator input (502) and receiving a second operator input (504), as described above in relation to FIG. 4.

The method may include selecting a mode (506). An operator may select the mode through the operator control interface 106. In one embodiment the operator may select the mode through the third portion 212C. The operator may select the mode by depressing one or more depressible devices 216. In one embodiment the operator may select a default mode when none of the depressible devices 216 are depressed. The default mode may be an automatic mode (508). The depressible devices may include a depressible device 216B which selects a trolling mode (520). The depressible devices may include a depressible device 216A which selects the synch mode (528). The depressible devices may include a depressible device 216C which selects a neutral mode (538). The depressible devices may include a depressible device 216D which selects a slow vehicle mode (546).

In alternative embodiments other modes may be chosen through other type operator inputs. The modes depicted in FIG. 5 are meant to be exemplary and not limiting.

When the automatic mode (508) is selected the controller 108 may deliver a power control signal to the first powertrain 110A, the second powertrain 110B, and the third powertrain 110C. The power control signal delivered to the first powertrain 110A may be indicative of a desired first engine 334A speed. The desired first engine 334A speed may be a function of the first operator input (510). The power control signal delivered to the third powertrain 110C may be indicative of a desired third engine 334C speed. The desired third engine 334C speed may be a function of the second operator input (512).

When a first set of conditions are met, the power control signal delivered to the second powertrain 110B may be indicative of a desired second engine 334B speed. The desired second engine 334B speed may be a function of the first operator input (516). When the first set of conditions are not met, the power control signal delivered to the second powertrain 110B may include a power control signal delivered to the second transmission 336B and a power control signal delivered to the second engine 334B. The power control signal delivered to the second transmission 336B may cause the second transmission 336B to operate in a neutral gear. The power control signal delivered to the second engine 334B may cause the second engine 334B to operate at idle speed (518).

The first set of conditions may include the first throttle 214A and the second throttle 214B having substantially the same rotational displacement from the neutral position, but in opposite directions. For example the first throttle 214A may be displaced 15 rotational degrees clockwise from the neutral position. The second throttle may be displaced 15 rotational degrees counter-clockwise from the neutral position. In this configuration the first throttle 214A and the second throttle 214B are both moved substantially the same distance forward around the axis 222. In other embodiments the first set of conditions may include the operator inputting substantially the same desired power for both sides of the vehicle 102.

The first set of conditions may include the operator inputting a minimum desired power threshold for the left (port) side of the vehicle 102, and a minimum desired power threshold for the right (starboard) side of the vehicle 102. For example, the first set of conditions may include the operator moving the first throttle 214A a minimum of twenty rotational degrees from the neutral position, and the operator moving the second throttle 214B a minimum of twenty rotational degrees from the neutral position.

In alternative embodiments the first set of conditions may include alternative conditions. In alternative embodiments the automatic mode may include different power control signals delivered to at least one of the first powertrain 110A, the second powertrain 110B, and the third powertrain 110C.

When the trolling mode is selected (520), the controller 108 may deliver a power control signal to the first powertrain 110A, the second powertrain 110B, and the third powertrain 110C.

The power control signal delivered to the first powertrain 110A may include a power control signal to the first engine 334A and the first transmission 336A. The power control signal to the first engine 334A may cause the first engine 334A to operate at a generally constant speed. The power control signal delivered to the first transmission 336A may be a function of the first operator input and may cause a clutch on the first transmission 336A to slip in a manner that controls the motive power being delivered to the vehicle 102 through the first powertrain 110A (522).

The power signal delivered to the third powertrain 110C may include a power control signal delivered to the third engine 334C and the third transmission 336C. The power control signal delivered to the third engine 334C may cause the third engine 334C to operate at a generally constant speed. The power control signal delivered to the third transmission 336C may be a function of the second operator input and may cause a clutch on the third transmission 336C to slip in a manner that controls the motive power being delivered to the vehicle 102 through the third powertrain 110C (524).

The power control signal delivered to the second powertrain 110B may include a power control signal delivered to the second engine 334B and the second transmission 336B. The power control signal delivered to the second engine 334B may cause the second engine 334B to operate at idle speed. The power control signal delivered to the second transmission 336B may cause the second transmission 336B to operate in a neutral gear (526).

When the synch mode is selected (528), the controller 108 may deliver a power control signal to the first powertrain 110A, the second powertrain 110B, and the third powertrain 110C. In the synch mode, the desired power to both sides of the vehicle and the center of the vehicle is inputted by the operator through one portion of the operator control interface 106. The operator may be permitted to select a synch portion of the operator control interface 106, or the controller 108 may contain a selection in the controller 108 memory (530). For example, the operator may be able to select one of the first throttle 214A and the second throttle 214B as the synch input.

The power control signal delivered to the first powertrain 110A may be indicative of a desired first engine 334A speed. The desired first engine 334A speed may be a function of the synch operator input (532). The power control signal delivered to the second powertrain 110B may be indicative of a desired second engine 334B speed. The desired second engine 334B speed may be a function of the synch operator input (534). The power control signal delivered to the third powertrain 110C may be indicative of a desired third engine 334C speed. The desired third engine 334C speed may be a function of the synch operator input (536).

When the neutral mode is selected (538), the controller 108 may deliver a power control signal to the first powertrain 110A, the second powertrain 110B, and the third powertrain 110C.

The power control signal delivered to the first powertrain 110A may include a power control signal delivered to the first engine 334A and the first transmission 336A. The power control signal delivered to the first engine 334B may cause the first engine 334B to operate at idle speed. The power control signal delivered to the first transmission 336A may cause the first transmission 336A to operate in a neutral gear (540).

The power control signal delivered to the second powertrain 110B may include a power control signal delivered to the second engine 334B and the second transmission 336B. The power control signal delivered to the second engine 334B may cause the second engine 334B to operate at idle speed. The power control signal delivered to the second transmission 336B may cause the second transmission 336B to operate in a neutral gear (542).

The power control signal delivered to the third powertrain 110C may include a power control signal delivered to the third engine 334C and the third transmission 336C. The power control signal delivered to the third engine 334C may cause the third engine 334C to operate at idle speed. The power control signal delivered to the third transmission 336C may cause the third transmission 336C to operate in a neutral gear (544).

When the slow vessel mode (546) is selected the controller 108 may deliver a power control signal to the first powertrain 110A, the second powertrain 110B, and the third powertrain 110C. The power control signal delivered to the first powertrain 110A may be indicative of a desired first engine 334A speed and a reduced first engine 334A idle speed. The desired first engine 334A speed may be a function of the first operator input (548). The power control signal delivered to the third powertrain 110C may be indicative of a desired third engine 334C speed and a reduced third engine 334C idle speed. The desired third engine 334C speed may be a function of the second operator input (550).

When a second set of conditions are met, the power control signal delivered to the second powertrain 110B may be indicative of a desired second engine 334B speed and a reduced second engine 334B idle speed. The desired second engine 334B speed may be a function of the first operator input (554). When the second set of conditions are not met, the power control signal delivered to the second powertrain 110B may include a power control signal delivered to the second transmission 336B and a power control signal delivered to the second engine 334B. The power control signal delivered to the second transmission 336B may cause the second transmission 336B to operate in a neutral gear. The power control signal delivered to the second engine 334B may cause the second engine 334B to operate at a reduced idle speed (556).

In one embodiment, the second set of conditions may be identical to the first set of conditions. In an alternative embodiment the second set of conditions may contain a different desired power thresholds (552).

From the foregoing it will be appreciated that, although specific embodiments have been described herein for purposes of illustration, various modifications or variations may be made without deviating from the spirit or scope of inventive features claimed herein. Other embodiments will be apparent to those skilled in the art from consideration of the specification and figures and practice of the arrangements disclosed herein. It is intended that the specification and disclosed examples be considered as exemplary only, with a true inventive scope and spirit being indicated by the following claims and their equivalents.

What is claimed is:

1. A vehicle control system, comprising:

a first powertrain including a first power source, a second powertrain including a second power source, a third powertrain including a third power source, an operator control interface including a first portion configured to receive a first operator input and a second portion configured to receive a second operator input, the first operator input and the second operator input indicative of a desired speed and a desired direction, a controller configured to deliver a power control signal to at least one of the first powertrain, the second powertrain, and the third powertrain, wherein each powertrain comprises an engine and a transmission, and wherein the power control signal is a function of the first operator input and the second operator input;

wherein the controller further comprises a master controller and a follower controller, and a plurality of pairs of engine and transmission controllers, each pair comprising a single engine controller and a single transmission controller, each pair being respectively interposed between, and in signal communication with one of the first, second, and third powertrains; and wherein the master controller is operably coupled to and in direct signal communication with only two of the first, second, and third powertrains via their respective pairs of engine and transmission controllers, and wherein the follower controller is operably coupled to and in direct signal communication with only the remaining one of the first, second, and third powertrains via its respective pair of engine and transmission controllers.

2. The vehicle control system of claim 1, wherein the first portion comprises a lever, the second portion comprises a lever, and the position of the first lever and the position of the second lever is indicative of the desired speed and the desired direction.

3. The vehicle control system of claim 1, wherein the operator control interface further comprises a third portion, the third portion configured to receive a third operator input indicative of a mode selection, and the power control signal is a function of the first operator input, the second operator input, and the third operator input.

4. The vehicle control system of claim 3, wherein the first portion comprises a lever, the second portion comprises a lever, the third portion comprises a mode selection switch, and the position of the first lever, the position of the second lever, and the mode selection is indicative of the desired speed and the desired direction.

5. The vehicle control system of claim 3 wherein the third portion is configured to select one of a normal mode, a synch mode, and a trolling mode.

6. The vehicle control system of claim 1, wherein the first power source comprises an internal combustion engine, the second power source comprises an internal combustion engine, and the third power source comprises an internal combustion engine.

7. The vehicle control system of claim 6, wherein the power control signal is indicative of a desired engine speed.

8. The vehicle control system of claim 1, wherein:

the first powertrain comprises a first transmission, the second powertrain comprises a second transmission, the third powertrain comprises a third transmission, and the controller is configured to deliver the power control signal to at least one of the first transmission, the second transmission, and the third transmission, wherein the power control signal is a function of the first operator input and the second operator input.

9. The vehicle control system of claim 1, wherein:

the first powertrain further comprises one of a propeller and an impeller, the second powertrain further comprises one of a propeller and an impeller, and the third powertrain further comprises one of a propeller and an impeller.

10. A vehicle control method for managing a plurality of controllers adapted for signal communication with multiple powertrains and power sources, including engines and transmissions, comprising:

receiving a first operator input, receiving a second operator input, delivering a power control signal to at least one of a first powertrain including a first power source, a second powertrain including a second power source, and a third powertrain including a third power source, and wherein the first operator input and the second operator input are indicative of a desired speed and a desired direction, and wherein the power control signal is a function of the first operator input and the second operator input;

providing a master controller and a follower controller, and a plurality of pairs of engine and transmission controllers, each pair comprising a single engine controller and a single transmission controller;

interposing each pair respectively between, and in signal communication with, one of the first, second, and third powertrains; and providing the master controller to be operably coupled to and in direct signal communication with only two of the first, second, and third powertrains via their respective pairs of engine and transmission controllers; and providing the follower controller to be operably coupled to and in direct signal communication with only the remaining one of the first, second, and third powertrains via its respective pair of engine and transmission controllers.

11. The vehicle control method of claim 10, further comprising selecting a mode, and wherein the first operator input, the second operator, and the mode are indicative of a desired speed and a desired direction, and the power control signal is a function of the first operator input, the second operator input, and the mode.

12. The vehicle control method of claim 11, further comprising:

delivering a first power signal to the first power source as a function of the first operator input, delivering a second power signal to the second power source as a function of the first operator input when a set of conditions are met, and delivering a third power signal to the third power source as a function of the second operator input.

13. The vehicle control method of claim 12, wherein the second powertrain includes a transmission and the second power source includes an engine, and further comprising:

a) delivering a neutral signal to the transmission when the set of conditions are not met, and b) delivering an idle signal to the engine when the set of conditions are not met.

14. The vehicle control method of claim 11, wherein the first powertrain includes a first transmission, the second powertrain includes a second transmission, and the third powertrain includes a third transmission; and further comprising:

a) delivering a first power signal to the first transmission as a function of the first operator input, b) delivering a neutral gear signal to the second transmission, and c) delivering a second power signal to the third transmission as a function of the second operator input.

15. The vehicle control method of claim 11, further comprising:

selecting one of the first operator input and the second operator input as a synch operator input, delivering a first power signal to the first power source as a function of the synch operator input, delivering a second power signal to the second power source as a function of the synch operator input, and delivering a third power signal to the third power source as a function of the synch operator input.

16. The vehicle control method of claim 11, wherein the first powertrain includes a first engine and a first transmission, the second powertrain includes a second engine and a second transmission, and the third powertrain includes a third engine and a third transmission; and further comprising:

a) delivering an idle signal to the first engine, b) delivering an idle signal to the second engine, c) delivering an idle signal to the third engine, d) delivering a neutral signal to the first transmission, e) delivering a neutral signal to the second transmission, and f) delivering a neutral signal to the third transmission.

17. The vehicle control method of claim 11, wherein the first powertrain includes a first engine, the second powertrain includes a second engine, and the third powertrain includes a third engine; and further comprising:

a) delivering a first power signal to the first engine as a function of the first operator input, b) delivering a second power signal to the second engine as a function of the first operator input when a set of conditions are met, c) delivering a third power signal to the third engine as a function of the second operator input, d) reducing the first engine idle speed, e) reducing the second engine idle speed, and f) reducing the third engine idle speed.

18. The vehicle control method of claim 17, wherein the second powertrain includes a transmission; and further comprising:

a) delivering a neutral signal to the transmission when the set of conditions are not met, and b) delivering an idle signal to the second engine when the set of conditions are not met.

19. A marine vessel comprising:

a port side powertrain including a first engine and a first transmission, a starboard side powertrain including a second engine and a second transmission, a center powertrain including a third engine and a third transmission, an operator control interface including a first throttle configured to receive a first operator input and a second throttle configured to receive a second operator input, the first operator input and the second operator input indicative of a desired speed and a desired direction, a controller configured to deliver a power control signal to at least one of the port side powertrain, the starboard side powertrain, and the center powertrain, wherein the power control signal is a function of the first operator input and the second operator input;

wherein the controller further comprises a master controller and a follower controller, and a plurality of pairs of engine and transmission controllers, each pair comprising a single engine controller and a single transmission controller, each pair being respectively interposed between, and in signal communication with one of the first, second, and third powertrains; and wherein the master controller is operably coupled to and in direct signal communication with only two of the first, second, and third powertrains via their respective pairs of engine and transmission controllers, and wherein the follower controller is operably coupled to and in direct signal communication with only the remaining one of the first, second, and third powertrains via its respective pair of engine and transmission controllers.

* * * * *